United States Patent [19]

Cox et al.

[11] 4,285,350

[45] Aug. 25, 1981

[54] HAIRSTYLING AID

[76] Inventors: Ginger C. Cox, 4204 Cherokee Trail, Fort Worth, Tex. 76133; Sandra F. Scott, 4945 Penrose, Fort Worth, Tex. 76116

[21] Appl. No.: 135,360

[22] Filed: Mar. 31, 1980

[51] Int. Cl.[3] ..... A45D 1/00

[52] U.S. Cl. ..... 132/9

[58] Field of Search ..... 132/9, 31, 38 X; 34/96

[56] References Cited

U.S. PATENT DOCUMENTS

| | | | |
|---|---|---|---|
| 3,014,220 | 12/1961 | Weld | 130/9 UX |
| 3,315,688 | 4/1967 | Sbarra | 132/9 |

*Primary Examiner*—G. E. McNeill

*Attorney, Agent, or Firm*—James E. Bradley

[57] ABSTRACT

An apparatus for use in hairstyling has features that allow several strands of hair to be held away from the scalp of the user to facilitate hairstyling techniques. The apparatus includes a rigid loop that is supported around the head of a user. A number of arms are secured to the loop and extend upwardly and outwardly from the loop. Each arm has a clip for retaining a strand of hair. The arms are positionable at any point in space, within the limits of their lengths, to retain the strands of hair at any selected points.

10 Claims, 4 Drawing Figures

HAIRSTYLING AID

BACKGROUND OF THE INVENTION

1. Field of the Invention

This invention relates in general to mechanical devices for assisting in hairstyling, and in particular to a device that assists in preparing woven hair styles.

2. Description of the Prior Art

During hairstyling, it is sometimes necessary to hold several strands of hair away from the scalp simultaneously. This is particularly a problem in hair weaving. In hair weaving, a single strand may be interlaced between eight or ten other strands held outward from the scalp and spread apart. Consequently, three or four operators are required to hold the numerous strands in position.

In U.S. Pat. No. 3,315,688, a hood frame is shown that has a band encircling the head. Loops of wire are supported by the band and extend over the head. Clips are located on the loops for retaining strands of hair.

The device shown in this patent would not aid in hair weaving. The loops are too close to the head to hold long strands away from the scalp. The loops would interfere with the operator's movements. Moreover, the loops cannot be moved to various positions to hold the strands at the desired places.

SUMMARY OF THE INVENTION

It is accordingly a general object of this invention to provide an improved device in hairstyling that will hold long strands of hair away from the scalp.

It is a further object of this invention to provide an improved device for use in hairstyling that will hold strands of hair away from the scalp and will also allow the positions of the strands to be moved to accommodate operator movement.

In accordance with these objects, a device is provided that includes a band or loop that is supported around the head of the user. A number of arms are secured to the band and extend upwardly. These arms have free ends which contain clips for holding the strands. The arms are capable of being positioned at any point in space within the limits of the length of the arms.

In the preferred embodiment, the arms have a joint, dividing the arms into movable upper and lower sections. The lower section is connected to the loop pivotally so that it can rotate in two planes.

In one embodiment, the support consists of brace that rest on the user's chest and back, with straps extending between them for resting on the user's shoulders.

DESCRIPTION OF THE PREFERRED EMBODIMENTS

Figure 1:
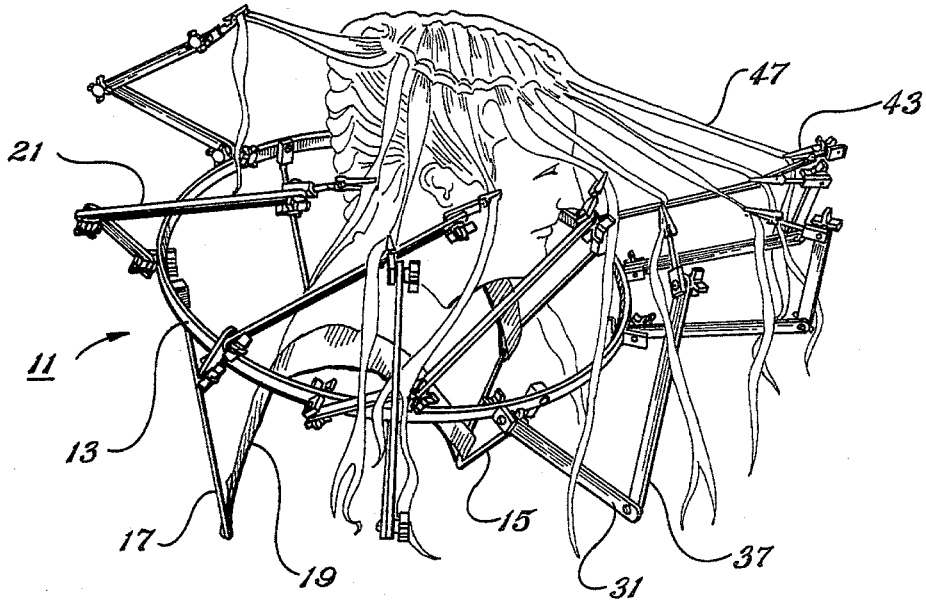
FIG. 1 is a perspective view illustrating a hairstyling aid constructed in accordance with this invention.

Referring to FIG. 1, hairstyling aid 11 includes a circular band or loop 13. Loop 13 is a metal strip having flat sides and formed in a circle. Loop 13 is supported around the user's head, preferably at a height about even with the user's ears. The diameter of loop 13 is somewhat greater than the width of the average user's shoulders. The support means for loop 13 in the embodiment of FIG. 1 includes a front brace 15. Brace 15 is a wire bent into a generally U-shaped configuration, with the bottom of the brace adapted to rest against the user's chest. The upper ends of the legs of the brace 15 are secured to the loop 13. A back brace 17, also in a generally U-shaped configuration, has a bottom section adapted to rest against the user's back, below the shoulders. The upper ends of the legs of the back brace 17 are also secured to the loop 13, but on opposite sides from the brace 15. A pair of flexible straps 19 extend from the bottom section of the front brace 15 to the bottom section of the back brace 17. The straps are spaced apart and are adapted to rest on the shoulders of the user.

Figure 2:
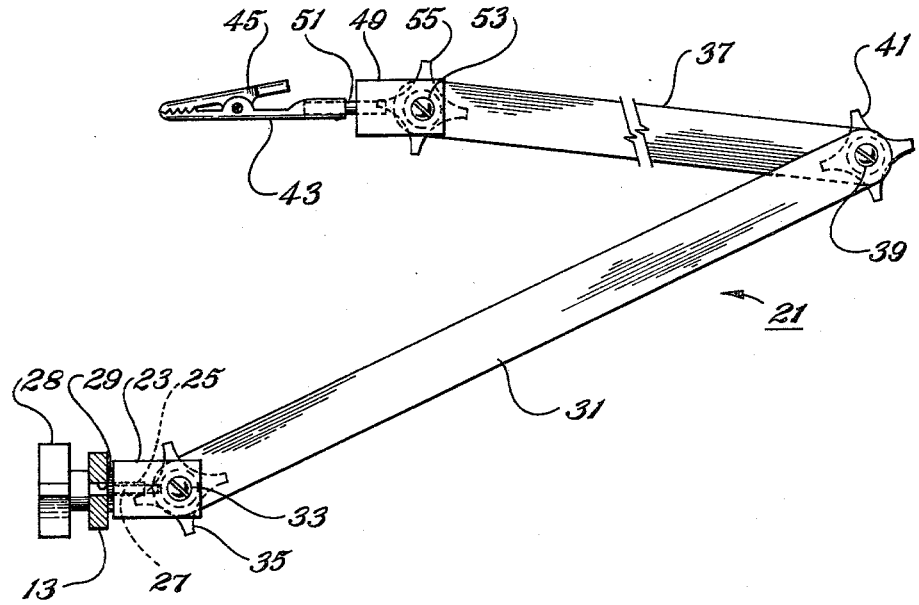
FIG. 2 is an enlarged side view, partially sectioned, of one of the arms of the hairstyling aid of FIG. 1.

A plurality of arms 21 are secured to the loop 13. Referring also to FIG. 2, the connection means for connecting the arms 21 to the loop 13 includes a flat bracket 23 that extends radially outward from loop 13. Bracket 23 has a threaded hole 25 that is aligned with a radial line emanating from the center of loop 13. A screw 27 having a large head or knob 28 on its end for ease in gripping, is adapted to extend through a hole 29 in loop 13, and into the threaded hole 25 for frictionally engaging bracket 23 with loop 13.

Arm 21 includes a lower section 31 that consists of a flat, elongated strip that is pivotally secured to the bracket 23. Lower section 31 is secured by a screw 33 that extends through holes in bracket 23 and lower section 31 perpendicular to screw 27. Screw 33 is retained by an enlarged knob 35 on the opposite side for frictionally engaging bracket 23 with lower section 31. Each arm 21 also includes an upper section 37 that is pivotally secured to the lower section 31 by a joint means. The joint consists of a screw 39 that extends through holes in the lower section 31 and upper section 37 parallel with screw 33. Screw 39 is retained by a knob 41 for frictionally engaging lower section 31 with upper section 37.

The upper section 37 has a free end that carries a clip 43. Clip 43 is of a typical type known as an "alligator" clip. It has two jaws urged toward each other by a spring, each jaw having serrations or teeth for gripping. One jaw has a tab 45, which may be depressed to open the jaws to receive a strand 47 (FIG. 1) of hair. Clip 43 is pivotally secured to the free end of the upper section 37 by a bracket 49. Bracket 49 has an outwardly protruding pin 51 over which the tubular back portion of clip 43 extends. Bracket 49 is secured to the upper section 37 by a screw 53. Screw 53 extends through holes in bracket 49 and upper section 37. A knob 55 retains the threaded end of the screw 53, frictionally securing the upper section 37 to the bracket 49.

In operation, the hairstyling aid 11 is placed over the user, with the straps 19 resting on the shoulders of the user. Typically, the loop 13 will have eight to ten arms 21. It will have considerably more holes 29, enabling the arms 21 to be positioned at various radial points around the loop 13. To place the arms 21 in position for receiving strands 47, first the knob 28 of the connection means is loosened. Then bracket 23 is pivoted or rotated about the axis of hole 29. This rotates screw 33 in a plane that is tangent to the loop at that point. This rotation enables arm 21 to be oriented upright, or obliquely at any inclined position with respect to loop 13, including crisscrossing with other arms 21, if need be. Once the lower section 31 is in the desired position, knob 28 is tightened to retain the position.

Then, if needed, knob 35 is loosened to move the lower section 31 toward or away from the user. During this movement, the lower section 31 pivots or rotates about the axis of screw 33 in a plane that contains a radial line of loop 13. Once the proper position is reached, knob 35 is tightened to retain the lower section 31 in the desired position. Knob 41 may also be loosened. This enables the upper section 37 to rotate around screw 39 in a plane that is parallel with a plane containing the lower section 31. Once this position is reached, knob 41 is tightened to retain the position of the upper section 37. Clip 43 can also be positioned by loosening knob 55 and rotating bracket 49 around screw 53 with respect to the upper section 37. Once positioned, knob 55 is tightened. When in position, or before positioning, a strand 47 of hair may be placed in the jaws of the clip 43 and held tightly away from the user's scalp.

In this manner, strands 47 of hair can be pulled away from the scalp, generally as shown in FIG. 1. Then, one strand 47 may be released from its clip 43, and interwoven under and over the other strands. When it reaches the other side, another clip 43 of another arm 21 will retain it. A second strand 47 will then be woven through the other strands and retained. During the weaving operation, the arms 21 maybe continuously repositioned to hold the strands 47 in the desired positions. The articulation of each arm 21 allows clip 43 to be placed at any point in a space bounded only by the length of the arm 21. Brackets 23 and 49, the joint at screw 39, and the connection at bracket 23 serve as positioning means for allowing the arms to be moved in space.

Figure 3:
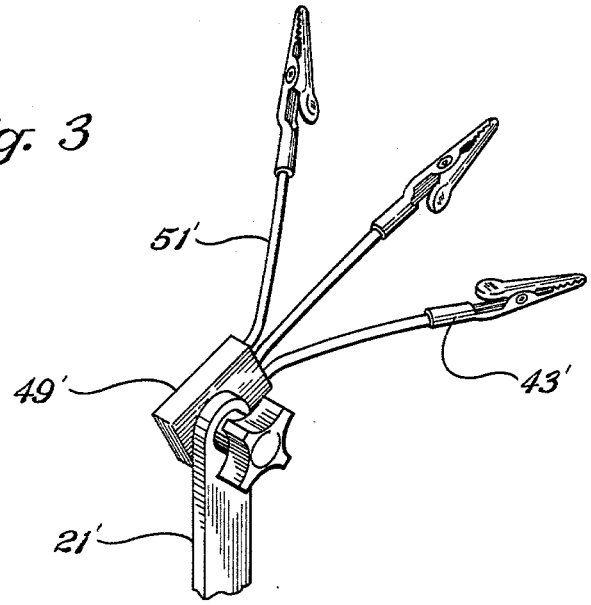
FIG. 3 is an enlarged side view of the end of one of the arms of FIG. 1, showing an alternate embodiment of the clips.

FIG. 3 discloses an alternate embodiment for the clips 43 of FIG. 2. In this embodiment, bracket 49' has three pins 51' extending outwardly from it. Each pin 51' is bent to space the ends apart from each other. Three clips 43' are secured to the ends. This arrangement allows an arm 21' to hold three strands of hair.

Figure 4:
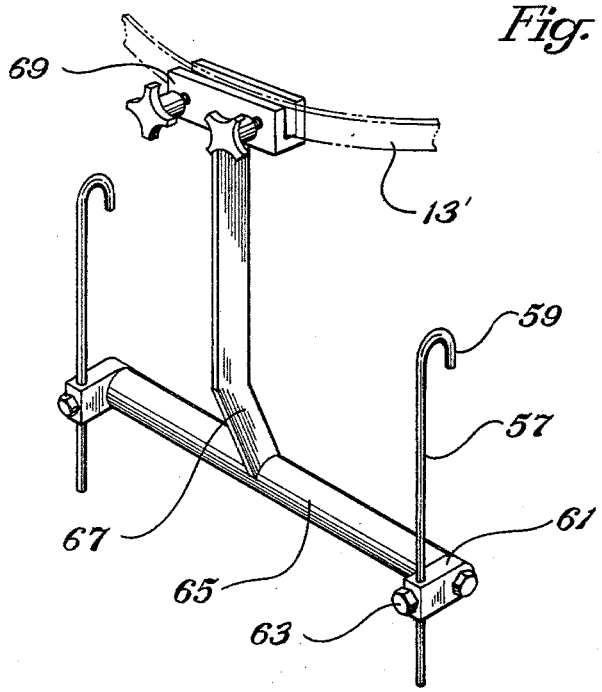
FIG. 4 is a perspective view of an alternate embodiment of a supporting device for the hairstyling aid of FIG. 1.

FIG. 4 discloses an alternate embodiment for supporting the loop 13 of FIG. 1. This supporting means includes a pair of hooks 57. Hooks 57 have curved upper ends 59 for fitting over the upper edge of the back of a chair (not shown). Hooks 57 are secured in brackets 61 by a screw 63 that allows the length that the hooks 57 extend upwardly to vary. Brackets 61 also allow the hooks 57 to rotate the curved portions 59 to oblique positions for tight retention with chairs with thin backs. Brackets 61 are connected together by a horizontal bar 65 that bears against the back side of the chair. A vertical bar 67 is rigidly secured to the bar 65 midway between the brackets 61 and extends upwardly. A clamp 69 located at the top of the vertical bar 67 is adapted to clamp loop 13' of the hairstyling aid. Clamp 69 may be a type that can slide up and down bar 67 to vary the height of loop 13. Also it may have pivoting means to allow the loop 13' to be tilted upward for access. The support of FIG. 4 may be used instead of or in conjunction with the support of FIG. 1.

An invention having significant advantages has been provided. The hairstyling aid will hold many strands of hair spaced apart and outward from the scalp, enabling hairstyling to be conducted. The numerous arms obviate the need for more than one operator to be used during weaving styling. The flexibility of positioning of the arms facilitates hairstyling.

While the invention has been shown in only three of its forms, it should be apparent to those skilled in the art that it is not so limited, but is susceptible to various changes and modifications without departing from the spirit thereof.

We claim:

1. An apparatus for use in hairstyling, comprising:
- a rigid loop;
- support means for supporting the loop around the head of a user;
- a plurality of arms having one free end and one end secured to the loop;
- a clip secured to the free end of each of the arms for retaining a strand of the user's hair; and
- positioning means for allowing the free ends of the arms to be moved in space, and for retaining the positions of the arms until subsequently moved, to retain strands of hair at different points.

2. The apparatus according to claim 1 wherein the positioning means comprises:
- a joint intermediate the ends of each of the arms, dividing each arm into upper and lower sections that are movable with respect to each other.

3. The apparatus according to claim 2 wherein the lower section of each arm is secured to the loop by connection means for allowing selected pivoting of the lower section with respect to the loop to vary the positioning.

4. The apparatus according to claim 3 wherein the connection means allows selected pivoting of the lower section in directions toward and away from the loop, and also in oblique directions with respect to the loop.

5. The apparatus according to claim 2 wherein the joint allows the upper section to be selectively pivoted toward and away from the lower section.

6. An apparatus for use in hairstyling, comprising:
- a circular rigid loop;
- supporting means for supporting the loop around the head of a user;
- a plurality of arm lower sections pivotally secured to the loop for selected repositioning of the lower sections with respect to the loop;
- a plurality of arm upper sections, each pivotally secured to a lower section for selected repositioning of the upper section with respect to the lower section; and
- a plurality of clips, each secured to a free end of one of the upper sections for receiving a strand of the user's hair.

7. The apparatus according to claim 6 wherein the supporting means comprises:
- a front brace depending from the loop for contact with the user's chest;
- a back brace depending from the loop for contact with the user's back; and
- a pair of spaced apart straps extending between the front and back braces for resting on the user's shoulders.

8. The apparatus according to claim 6 wherein the supporting means comprises:
- a pair of hooks secured together by a horizontal bar and extending upwardly, each hook having a curved upper end for placing over a chair, with the bar behind the chair;
- a supporting rod secured to the bar between the hooks and extending upwardly; and connection means for connecting the rod to the loop.

9. The apparatus according to claim 6 wherein the connection means comprises:

a bracket;

a first screw radially mounted with respect to the loop and frictionally engaging the bracket with the loop, allowing the bracket to rotate about the first screw when the first screw is loosened; and a second screw mounted perpendicular to the first screw and frictionally engaging the bracket with the lower section, allowing the lower section to rotate about the second screw when the second screw is loosened.

10. The apparatus according to claim 9 wherein the joint means comprises:

a third screw mounted parallel with the second screw and frictionally engaging the upper section with the lower section, allowing the upper section to rotate about the third screw when the third screw is loosened.

* * * * *